United States Patent [19]

Brasher

[11] Patent Number: 4,585,229

[45] Date of Patent: Apr. 29, 1986

[54] EXERCISING APPARATUS

[76] Inventor: Tallie J. Brasher, P.O. Box 15689, Baton Rouge, La. 70895

[21] Appl. No.: 633,343

[22] Filed: Jul. 23, 1984

[51] Int. Cl.[4] ..... A63B 13/00

[52] U.S. Cl. ..... 272/123; 272/143

[58] Field of Search ..... 272/62, 68, 93, 116, 272/117, 122, 123, 124, 125, 126, 118, 143

[56] References Cited

U.S. PATENT DOCUMENTS

| | | | |
|---|---|---|---|
| 3,231,270 | 1/1966 | Wiwer | 272/123 |
| 3,384,370 | 3/1965 | Bailey et al. | 272/84 |
| 3,756,597 | 11/1971 | Monti | 272/81 |
| 3,904,198 | 4/1974 | Jones | 272/81 |
| 4,461,473 | 7/1984 | Cole | 272/123 |
| 4,471,956 | 9/1984 | Marlo | 272/123 |

FOREIGN PATENT DOCUMENTS

| | | | |
|---|---|---|---|
| 416167 | 10/1910 | France | 272/122 |

*Primary Examiner*—Richard J. Apley
*Assistant Examiner*—Robert W. Bahr
*Attorney, Agent, or Firm*—David L. Ray

[57] ABSTRACT

An exercising apparatus including a bar having a pair of rings slidably connected thereto, handles for gripping by the hand of the user positioned within and rotatably connected to each of the rings, and a cable connecting the two rings for maintaining each ring at an equal distance from the end of the bar.

17 Claims, 5 Drawing Figures

EXERCISING APPARATUS

BACKGROUND OF THE INVENTION

1. Field of the Invention

The present invention relates to an apparatus for exercising the human body. More particularly, the invention relates to an exercise apparatus having two hand holds which can be rotated and moved laterally apart.

2. Description of the Prior Art

Weight lifting devices and exercising machines are well known in the prior art. One of the common exercising devices is the barbell consisting of a elongated bar having weights at each end thereof. To exercise with the barbell, the operator may raise and lower the barbell from and to the ground while standing, and may lie in the prone position and raises and lowers the bar bell above his chest.

The position of the hands relative to the bar on the conventional barbell is fixed. The hands must grasp the elongated bar with the knuckles facing upward or with the palms facing upward. The hands must remain in a fixed position while lifting the barbell and the wrist cannot be rotated. The hands cannot be moved laterally away or toward each other without the risk of dropping the barbell. Thus, the specific muscles which are exercised using the common barbell are limited and dumb bells which can be held in one hand, or other weight lifting equipment, must be used to exercise muscles not exercised by the barbell.

U.S. Pat. No. 3,384,370 discloses a weight lifting apparatus having rotatable handle means mounted in a pair of rings which are rigidly connected to a rod. The rod is in three sections, one section joining the two rings and two other sections extending outwardly from the rings to which weights are attached. The rotatable handle means cannot be moved laterally toward each other or away from each other; their position is fixed on the weight lifting bar.

U.S. Pat. No. 3,904,198 discloses an exercise bar including a pair of dependent shafts at oposite ends of the bar with each shaft being threaded to receive weight plates. Hand grips or a pair of freely rotatably members positioned on the bar adjacent oposite ends thereof to permit the weights to move in a complete circle around the bar while performing exercise such as overhead lift from the floor, forward curl, reverse curl, knee bends, shoulder press, and the like. The hand grips cannot be moved toward each other nor may the hand grips be rotated.

U.S. Pat. No. 3,756,597 discloses an exercising shaft having two hand grips which can be spring loaded to allow limited movement of the hand grips toward and away from each other.

SUMMARY OF THE INVENTION

In accordance with the present invention, there is provided an exercising apparatus including a bar means having a pair of rings slidably connected thereto, handles for griping by the hand of the user positioned within and rotatably connected to each of the rings, and a cable connecting the two rings for maintaining each ring at an equal distance from the end of the bar.

The weight lifting apparatus of the invention has many advantages over weight lifting or exercising bars of the prior art. The exercising apparatus of the invention allows the user complete freedom of movement of his wrists while exercising in addition to allowing the user to move his hands apart or bring them together. Thus, the weight lifter can reach the most comfortable position and turn and move his arms while lifting weights or exercising with the exercising bar of the invention.

Furthermore, the exercising apparatus of the invention has the advantage that the hands as they move laterally together or apart are maintained at an equal distance from the ends of the bar so that the bar can be balanced over the head of the user with an equal weight on each arm.

The exercising apparatus of the invention thus allows the user much more freedom of movement of his hands and much more comfort and stability when lifting weights or exercising with the bar of the invention. Furthermore, if desired, the user can lock the handles to the bar so that they will not move laterally along the bar and thus the user can perform exercises with his hands close together or spread far apart or at any point therebetween.

BRIEF DESCRIPTION OF THE DRAWINGS

The invention will be more fully understood by reference to the drawings in which.

DESCRIPTION OF THE PREFERRED EMBODIMENTS

Figure 1:
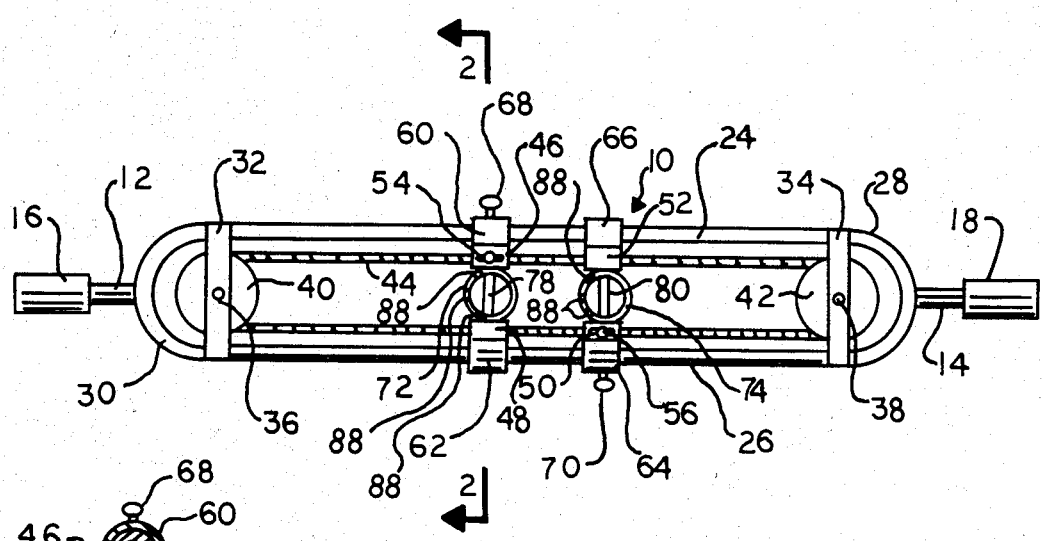
FIG. 1 is a front elevational view of the exercising bar of the invention.
Figure 2:
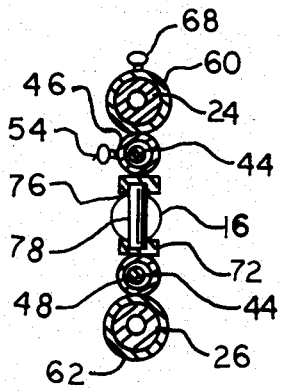
FIG. 2 is a cross-sectional view taken along lines 2—2 of FIG. 1.

Referring now to the drawings, and in particular FIGS. 1 and 2, the exercise bar of the invention includes a generally oval shaped bar 10 which may have two axially aligned end members 12 and 14. Rotatable sleeves 16 and 18 could be eliminated if desired. Weights may be connected directly to end members 12 and 14, but it is preferred that rotatable sleeves 16 and 18 be connected thereto for receipt of weights generally indicated by the numerals 20 and 22 in FIGS. 3 and 5. Rotatable sleeves 16 and 18 permit bar 10 to be rotated without turning or rotating weights 20 and 22.

Bar 10 is preferably made from steel and is circular in cross-section, as shown in FIG. 2. Bar 10 includes two elongated spaced apart parallel rods 24 and 26 which are connected by two semi-circular end sections 28 and 30. End pieces 12 and 14 may be connected to the semi-circular end sections 28 and 30 by welding or the like.

Figure 5:
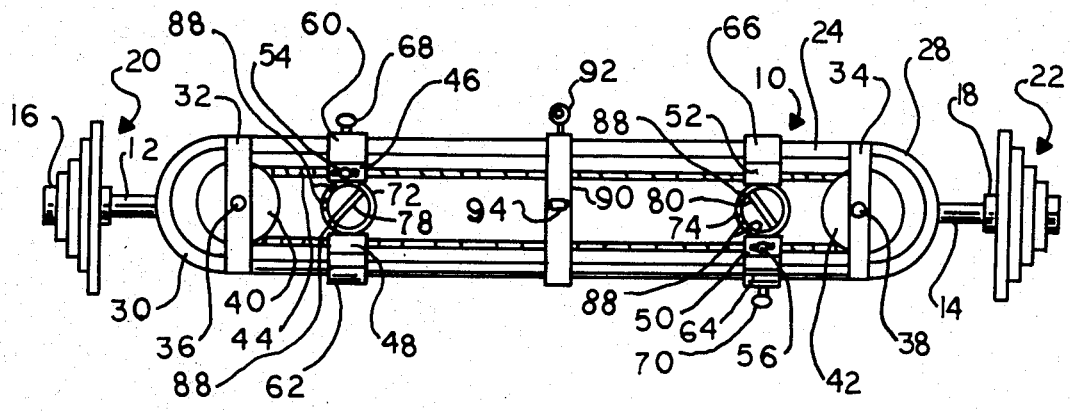
FIG. 5 is a front elevational view of the exercising bar of the invention with weights attached and the hand grips rotated from the position shown in FIG. 3.

Bar 10 may have a brace 90 shown in FIG. 5 rigidly connected to sections 24 and 26, although brace 90 may be omitted if desired. Brace 90 strengthens bar 10 by preventing rods 24 and 36 from flexing toward or away from each other.

An eye 92 may be rigidly connected to rod 24 or brace 90, so that a cable attached to a conventional weight and pulley combination (not shown) may be connected thereto. An additional eye indicated at 94 could be attached to the middle of brace 90 for similar attachment to a cable, weight stack, and pulley combination.

Connected to each end of bar 10 are two sheave brackets 32 and 34. Brackets 32 and 34 have pins 36 and 38 therein which extend through the center of sheaves 40 and 42. Sheaves 40 and 42 are preferably rotatably mounted on pins 36 and 38 but if desired they may be rigidly connected thereto to prevent rotation, and cable 44 would slide thereover. Furthermore, if desired, each of sheaves 40 and 42 could be replaced with tow sheaves of smaller diameter than sheaves 40 and 42 to shorten the overall length of bar 10 and maintain maximum grip width.

Cable 44 extends around the outside of sheaves 40 and 42. Cable 44 is received in sheeves 46, 48, 50 and 52. Sleeves 46 and 50 have set screws 54 and 56 therein respectively, which are tightened to secure the sleeves to the cable.

Connected to each of the sleeves 46, 48, 50 and 52 are larger sleeves 60, 62, 64 and 66. Larger sleeves 60, 62, 64 and 66 slidably receive rods 24 and 26 of bar 10 and are slidable thereon. Sleeves 60 and 64 have set screws 68 and 70 therein which permit the sleeves to be selectively locked in a desired position.

Rigidly connected by welding or the like to the bottom of sleeves 46 and 48, and 50 and 52 are rings 72 and 74. Ring 72 has a channel 76 therein as shown in FIG. 2 and ring 74 has an identical channel (not shown) therein.

Slidably received in the two channels in rings 72 and 74 are two bars 78 and 80. Bars 78 and 80 are used for gripping by the hands of the user and rotate within rings 72 and 74. Bars 78 and 80 may have locking devices such as set screws 88 attached thereto for locking them in any desired position of rotation.

Figure 3:
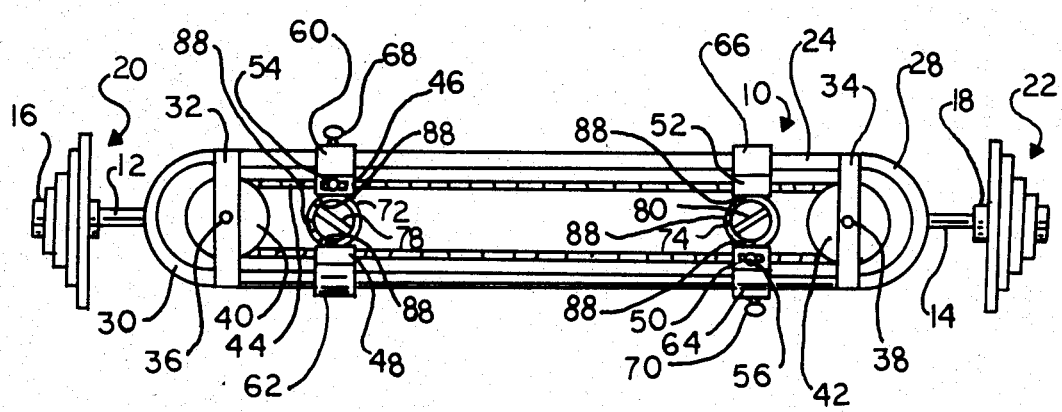
FIG. 3 is a front elevational view of the exercising bar of the invention with weights attached and the hand grips spread apart.
Figure 4:
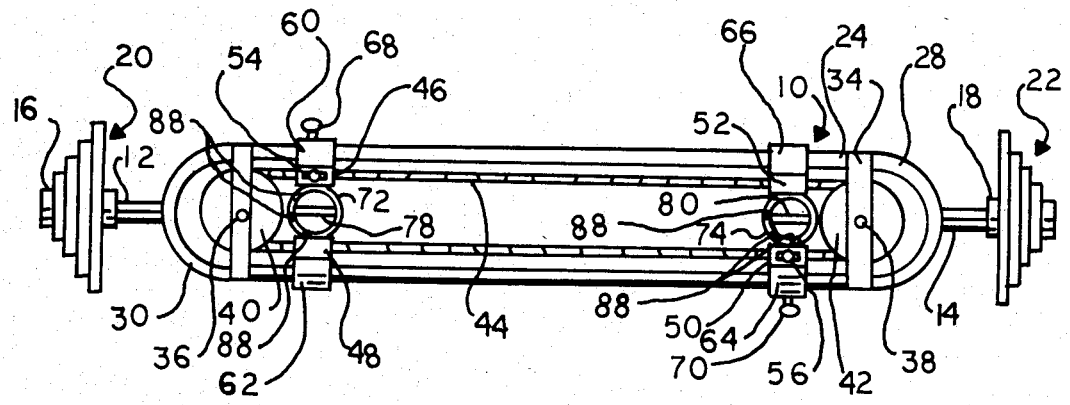
FIG. 4 is a front elevational view of the exercising bar of the invention with weights attached and the hand grips moved to their farthest apart position and rotated to be aligned with the center of the weights.

To use the exercising bar of the invention, set screws 54 and 56 are tightened to secure sleeves 46 and 50 to cable 44 after placing rings 72 and 74 adjacent each other in the center of bar 10 equidistantly between pulleys 40 and 42. Thereafter, when rings 72 and 74 are moved apart, each of the rings will always be located equidistantly from sheaves 40 and 42 respectively and from the center of bar 10, thereby maintaining the exercising bar in a balanced position. For example as shown in FIGS. 3 and 4, as rings 72 and 74 are moved apart, the distance from each of the rings to the sheave adjacent to the ring is equal. If desired, set screws 68 and 70 may be tightened to secure rings 72 and 74 in any desired position on the bar.

In FIG. 4, handles 78 and 80 are shown to be rotated 45 degrees from the position shown in FIG. 3. As can be seen in FIG. 5, the handles 78 and 80 are rotated 90 degrees from the position shown in FIG. 3. In FIG. 4, rings 72 and 74 are shown in a position farthest away from each other.

It can be understood from the above that the rings 72 and 74 are maintained at an equal distance from the center of the bar and from the sheaves 40 and 42. As cable 44 rotates about sheaves 40, and 42, ring 72 is secured at its upper end to cable 44 by set screw 54 and ring 74 is secured as its lower end to cable 44 by set screw 56, and each ring is maintained at an equal distance from the center of the bar as the rings are moved apart from each other.

Although the preferred embodiments of the present invention have been disclosed and described in detail above, it should be understood that the invention is in no sense limited thereby, and its scope is to be determined by that of the following claims.

What is claimed is:

1. An exercising apparatus comprising:

a. bar means adapted to receive exercise weights said bar means having two sheaves connected thereto;

b. a pair of ring means slidably connected to said bar means;

c. means operatively connecting said ring means to said sheaves for slidably adjusting said ring means along said bar means; and d. handle means positioned within and rotatably connected to each of said rings.

2. The apparatus of claim 1 wherein said bar means comprises an oval shaped rigid bar.

3. The apparatus of claim 2 wherein said rigid bar has outer end members adapted for receipt of weights.

4. The apparatus of claim 3 wherein said outer end members have rotatable sleeves connected thereto for receipt of weights.

5. The apparatus of claim 1 wherein said bar comprises two spaced apart elongated rod means aligned parallel to each other, said two rod means being connected together at the ends thereof by two semi-circular rigid end pieces.

6. The apparatus of claim 5 wherein one of said two spaced apart elongated rod means has first eye means connected thereto.

7. The apparatus of claim 6 wherein said two spaced apart elongated rod means are connected at their center by brace means.

8. The apparatus of claim 7 wherein second eye means is connected to said brace means.

9. The apparatus of claim 1 wherein cable means extends around said two sheaves.

10. The apparatus of claim 9 wherein said ring means are connected to said cable means.

11. The apparatus of claim 10 wherein said ring means have connector means for connecting said ring means to said oval shaped bar.

12. The apparatus of claim 11 wherein said connector means comprises set screws.

13. The apparatus of claim 1 wheein said ring means contains locking means for rigidly locking said handle means to said ring means.

14. The apparatus of claim 13 wherein said locking means comprises set screw means.

15. An exercising apparatus comprising:

a. bar means adapted to receive exercise weights said bar means comprising two spaced apart elongated rod means aligned parallel to each other, said two rod means being connected together at the ends thereof by two semi-circular rigid end pieces, one of said two spaced apart elongated rod means having first eye means connected thereto;

b. a pair of sheaves connected to said bar means;

c. cable means extending around said pair of sheaves;

d. a pair of ring means slidably connected to said bar means, said ring means being connectable to said cable means; and e. handle means positioned within and rotatably connected to each of said ring means.

16. The apparatus of claim 15 wherein said two spaced apart elongated rod means are connected at their center by brace means, said brace means having second eye means connected thereto.

17. The apparatus of claim 16 wherein said ring means have connector means for connecting said ring means to said bar means.

* * * * *